US006167794B1

(12) United States Patent
Kathe

(10) Patent No.: US 6,167,794 B1
(45) Date of Patent: Jan. 2, 2001

(54) GUN BARREL VIBRATION ABSORBER

(75) Inventor: Eric L. Kathe, Ballston Lake, NY (US)

(73) Assignee: The United States of America as represented by the Secretary of the Army, Washington, DC (US)

( * ) Notice: Under 35 U.S.C. 154(b), the term of this patent shall be extended for 0 days.

(21) Appl. No.: 09/215,500

(22) Filed: Dec. 7, 1998

(51) Int. Cl.[7] ..... F41A 21/00; F41A 21/44
(52) U.S. Cl. ..... 89/14.05; 89/14.1; 42/76.01
(58) Field of Search ..... 42/97, 76.01; 89/14.05, 89/14.1

(56) References Cited

U.S. PATENT DOCUMENTS

| | | | | |
|---|---|---|---|---|
| 769,089 | * | 8/1904 | Johnson | 42/76.01 |
| 2,467,372 | * | 4/1949 | Permentier | 89/14.1 |
| 2,522,192 | * | 9/1950 | Porter | 42/97 |
| 2,845,737 | * | 8/1958 | Hoyer | 42/97 |
| 2,859,444 | * | 11/1958 | Reymond | 42/76.01 |
| 2,965,994 | * | 12/1960 | Sullivan | 89/14.1 |
| 3,122,061 | * | 2/1964 | Atchisson | 42/97 |
| 3,732,778 | * | 5/1973 | Betterman et al. | 42/97 |
| 4,346,643 | * | 8/1982 | Taylor et al. | 89/14.1 |
| 4,638,713 | * | 1/1987 | Milne et al. | 89/14.1 |
| 4,715,140 | * | 12/1987 | Rosenwald | 42/97 |
| 4,982,648 | * | 1/1991 | Bol et al. | 89/14.1 |
| 5,062,346 | * | 11/1991 | Hansen et al. | 89/14.1 |
| 5,423,145 | * | 6/1995 | Nasset | 42/97 |
| 5,505,118 | * | 4/1996 | Arnesen et al. | 89/14.3 |
| 5,650,586 | * | 7/1997 | Balbo et al. | 89/14.1 |
| 5,661,255 | * | 8/1997 | Webb, III | 42/76.01 |
| 5,794,374 | * | 8/1998 | Crandall | 42/97 |
| 5,798,473 | * | 8/1998 | Roblyer et al. | 42/97 |
| 5,860,242 | * | 1/1999 | O'Neil | 42/97 |
| 5,907,921 | * | 6/1999 | Rose et al. | 42/97 |

FOREIGN PATENT DOCUMENTS

2721390 * 12/1995 (FR) .

* cited by examiner

*Primary Examiner*—Darren W. Ark
(74) *Attorney, Agent, or Firm*—John F. Moran; Michael C. Sachs

(57) ABSTRACT

A weapon system includes a gun barrel and a vibration absorber fitted onto a free end of the gun barrel. The vibration absorber includes a compliant energy storage device, such as a spring, and a mass secured to the energy storage device. The potential energy stored in the spring and the kinetic energy stored in the mass inertia are dissipated in part as friction, and re-introduced in part to the gun barrel such that the re-introduced energy is out of phase relative to the gun barrel motion. As a result, the vibration absorber does not totally dissipate the stored energy, but rather reshapes the receptance of the gun system so as to significantly reduce the vibration energy that migrates into the gun structure from known disturbances. This improves the overall accuracy of the gun system. In addition, the vibration absorber reduces the load between the gun barrel and the projectile during launch, thereby reducing the gun barrel muzzle wear and the exit yaw rate of the projectile.

4 Claims, 3 Drawing Sheets

GUN BARREL VIBRATION ABSORBER

GOVERNMENTAL INTEREST

The invention described herein may be manufactured and used by or for the Government of the United States for governmental purposes without the payment of any royalties thereon.

FIELD OF THE INVENTION

This invention generally relates to the field of ballistics, and it particularly relates to a vibration absorber for use on a gun barrel, in order to enhance the structural stability of a weapon system which is subject to vibrational disturbance prior to the firing dynamics of launch. The absorber will increase the accuracy of the weapon system by reducing the variation in the initial conditions of the weapon, at the commencement of the highly non-linear dynamic equations that govern launch dynamics.

BACKGROUND OF THE INVENTION

Numerous attempts have been made to improve the accuracy of weapon systems, particularly those subject to vibrational disturbance. The vibrational disturbance concern has gained increasing importance and visibility with the advent of longer, more slender, gun barrels as typified by the XM291 tank gun system.

The reason for the current focus on this problem is two fold. First, decades of dedicated research and development have increased the accuracy of weapon systems in many areas. As the accuracy of the weapon systems has increased, the role of the vibrational disturbance has become more pronounced. Second, with the ever-increasing need for higher projectile exit velocities, impetus for longer and longer barrels is resulting in weapon systems that are more susceptible to flexural vibrations.

Conventional attempts to improve the accuracy of weapon systems can be generally categorized as follows:

Extension of the Gun Mount/Cradle

One means of reducing the receptance of a gun barrel to flexural vibrations is to decrease the effective cantilevered length of the gun system. This may be achieved by increasing the length of the supporting structure that holds the gun barrel. This effectively increases the ratio of stiffness to inertia of the system. The square of the ratio of stiffness to inertia is indicative of the resistance of a gun barrel to low frequency vibrations.

A variation on the extended mount approach has been to utilize a traditional mount to support the gun barrel, but to then incorporate damping pads via a mount extension, that couples the barrel to the cradle with low stiffness, but high damping. The result is that the mount extension need not be as solid, since increased stiffness is not the primary objective of the approach. An example of this approach is the British 30 mm, L21A1, system commonly called the RARDEN. (See Geeter et al, "Low Dispursion Automatic Cannon System (LODACS) Final Report (U)," ARDEC Technical Report ARSCD-TR-82011, Picatinny Arsenal, N.J., August 1982).

Although the extension of the gun mount/cradle has succeeded in reducing vibrations, it can present a negative impact of increasing the imbalance of several weapons systems, since the center of gravity of typical weapon systems is forward of the trunnion bearings. This imbalance necessitates the application of control torques, equal and opposite to the weight of the weapon system, multiplied by the horizontal offset of the center of gravity from the pivot point. These requirements place a heavy burden on the pointing system.

Further, for many weapon systems, extension of the gun mount/cradle becomes ungainly as the ratio of in-mount barrel length to overall barrel length increases. It would be a challenging endeavor to package such support structures in a fielded weapon system.

Increase of Gun Barrel Thickness

Gun barrels may be constructed with thicker walls. Since the stiffness is a function of the outer radius to the fourth power, and the inertia is a function of the outer radius to the second power, significant increase to the ratio of stiffness to inertia of the system can be made.

Thicker gun barrels increase the ratio of stiffness to inertia, but they require a significant ratio between the inner radius (the radius of the bore) and the outer radius. If the wall thickness, that is the difference between the inner and outer radii, is reasonably small relative to either radius, a thin walled approximation would have the inertia and stiffness increase proportionally to each other, thus no net gain. For example, a Taylor series expansion of the ratio of stiffness to inertia as a function of the outer diameter is dominated by the linear term for barrels whose wall thickness is a fraction of the bore radius. The second term exists, but it doesn't dominate until the wall thickness becomes impractical.

A related problem with this approach is that increased weight of the barrel is a direct consequence. This exacerbates both the extension of the center of gravity of the gun further out from the trunnions, and increases overall weapon weight which is supposed to be minimized.

Composite Barrel Construction

Gun barrels may be constructed of materials with a higher stiffness to inertia ratio, such as carbon fiber reinforced epoxy, or composite over-wraps of traditional gun steel barrels. The goal is to increase the net ratio of stiffness to inertia of the system, and this can be achieved. Reference is made to Hasenbein et al, "Metal Matrix Composite-Jacketed Cannon Tube Program," ARDEC-Benet Technical Report ARCCB-TR-91027, Watervliet Arsenal, N.Y., August 1991).

Composite barrel construction is a viable alternative to enhance the structural stability of weapon systems. It is however challenged by the need to protect the barrel from the hot and erosive action of the propellant gases. This typically results in a composite over-wrap incarnation over a thin-walled steel barrel. A remaining challenge is to maintain the bond between the base material and the composite over-wrap during both manufacture, especially the autofrettage process and the firing loads which create concurrent radial dilation of the barrel and axial recoil loads. This firing dynamic challenge is exacerbated by the pressure discontinuity that travels behind the obturation of the projectile with a speed that may resonate a traveling radial dialation wave of the bore surface. Other challenges include impaired heat transfer across the insulating composite and increased recoil velocity of the cannon during operation.

Fluted Gun Barrels

Gun barrels may be constructed with flutes that look like fins emanating from the center of the gun. In analogy with design of an "I-Beam" the general design concept is to get the steel at a greater radius for an increased stiffness, without increasing the inertia in proportion. An example of this approach is the British 30 mm, L21A1, system commonly called the RARDEN. (See Geeter et al, "Low Dispursion Automatic Cannon System (LODACS) Final Report (U)," ARDEC Technical Report ARSCD-TR-82011, August 1982). However, fluted gun barrels are expensive to manufacture, and they may compromise a desirable static stress distribution that is manufactured into most large caliber gun barrels using a process called autofrettage and they increase system weight.

Application of Active Controls: Feed-Forward Cancellation or Feed-Back Vibration Cancellation If the input excitation can be anticipated, a control signal can be applied through an actuation system to preempt the disturbance energy. An example for a tank gun system while traversing rough terrain would be the use of a sensor to detect the vertical acceleration of the tank hull, and to apply immediate counteraction force via the elevation actuator system. In many tank guns the center of gravity extends forward of the trunnion bearings. This is a result of the limited working volume within the armor protected turret. Thus, a vertical heave upwards applies a torque to the gun system that may be cancelled by an applied downward force at the elevation coupling, behind the trunnions.

For current systems, this concept of feed-forward cancellation treats the gun barrel as a rigid body, and ignores flexural modes, and in particular the first flexural mode which the vibration absorber of the present invention is designed to attenuate significantly. Inclusion of the inverse plant dynamics in the open loop control law could reduce this source of disturbance vibration energy, but would not usurp the vibration absorber.

The concept behind active feed-back vibration cancellation is to sense the vibrations of the structure under control, both amplitude and phase, and to apply control forces to the structure to cancel the detected vibrations. This requires both sensors, actuators, and the design of a stable control law; a means to determine what load to apply based on sensor information and apriori knowledge of the dynamic behavior of the system.

Active feed-back vibration cancellation presents fundamental problems with structural control. The partial differential equations that govern the vibrations of continua are termed "stiff." In this context "stiff" implies that structures contain many natural modes of vibrations with a wide variation in the time-constants or frequencies of response. Thus, although a gun barrel may be dominated by its first mode, on the order of 20 Hz for a tank gun system, it possesses vibratory modes with fundamental frequencies orders of magnitude higher. The result of this is that the speed of response required of an active control system is high, and may become impractical.

Additional challenges to feed-back vibration cancellation are stability related. Fundamentally, this type of active control attempts to cancel vibration energy with high force input to the structure. Relatively small discrepancies in the sensors and actuation can result in adding vibrational energy to the structure. This energy often collects in vibratory modes that were not included in the control formulation, particularly that, as a "stiff" system there are many natural modes. Thus, the vibration energy may not even be seen by the sensor system, or may migrate to frequencies that are too high for the actuation system.

Yet another challenge with this feed-back vibration approach is that the free-end of the gun barrel exhibits the most vibration; it is the anti-node of the structure, and yet it is removed from control forces by the cantilevered barrel length. From the perspective control system design theory the implication of this is that the system exhibits "non-minimum-phase" behavior. This behavior limits the so-called control gain that may be applied to the system because high gains may drive the system unstable. In other terms, the controlled system exhibits right-hand Laplace plane zeros. These zeros cause the locus of system poles to cross the imaginary axis from the left-hand-plane to the right as the feedback gain is changed. Once in the right hand plane, a pole drives the system unstable with ever increasing amplitude.

Smart Structures

Similar to the feed-back vibration cancellation technology described above, the smart structures include both actuation and sensor transducers to reduce-control vibrations within the structure itself. In the case of a gun barrel, a smart structure approach would entail the coupling of sensor and control mechanisms along the cantilevered span of the barrel. The main difference with the feed-back control method is that the dynamic system of the structure itself the gun is changed.

Smart structures include all of the challenges for feed-back control, except that the actuation force may be applied along the barrel, thus increasing the stability of the system. Moreover, smart structures tend to be relatively expensive and difficult to manufacture, especially for such an aggressive shock and vibration environment as a gun barrel.

U.S. Pat. No. 5,505,118 to Arnesen et al. describes a vibration damper that aims at reducing the longitudinal vibrations of a gun, that is abruptly loaded in tension by the muzzle braking system immediately following launch. By definition, this can not favorably affect the in-bore launch dynamics, as it is not activated until the muzzle brake is loaded by the exit of the round from the gun system. Further, the Arnesen et al. patent considers longitudinal vibrations, not transverse beam-type vibrations that affect center-line curvature. Therefore, the purpose of this patent relates neither to in-bore dynamics nor accuracy.

Other references that generally discuss gun dynamics are listed below:

E. Kathe, R. Gast, and S. Morris, "The Case for Transverse Dynamic Load Contribution to Down-Bore Wear of Artillery Cannon," Sagamore Workshop on Gun Barrel Wear and Erosion: Proceedings, Sponsored by the U.S. Army Research Laboratory (ARL), DuPont Country Club, Wilmington, Del., Jul. 29–31, 1996, pp. 235–244.

E. Kathe, R. Gast, P. Vottis, and M. Cipollo, "Analysis of Launch-Induced Motion of a Hybrid Electromagnetic/Gas Gun," IEEE Transactions on Magnetics, V33, N1, January 1997, pp. 178–183.

SUMMARY OF THE INVENTION

It is an object of the present invention to provide a weapon system with a vibration absorber that significantly reduces the flexural vibrations. The reduction of the flexural vibrations significantly increases the accuracy of the weapon system. The new vibration absorber can be readily retrofitted to existing weapon systems.

The vibration absorber of the present invention enhances the structural stability of weapon systems that are subject to vibrational disturbance prior to the firing dynamics of launch. When fitted to a gun barrel, a realization of the vibration absorber effects compliance between a forward collar of an existing shroud assembly and a muzzle end of the weapon system (such as a cannon). The vibration absorber dramatically reduces the receptance of the weapon system in a predetermined frequency range, for instance the frequency range of the first flexible mode, near 19 Hz, with little or no discernible penalty in the frequency range driven by the tank chassis upon its suspension near 2 Hz.

The vibration absorber increases the accuracy of the weapon system by reducing the variation in the initial conditions of the weapon at the commencement of the highly non-linear partial differential equations that govern launch dynamics. For example, the vibration absorber can be used to suppress flexural vibrations of an extended length tank gun barrel as the tank traverses rough terrain. Further application is for rapid-fire systems, where the vibrations caused by the launch of a previous round are not settled by the time the following round is launched.

The foregoing and additional features and advantages of the present invention are realized by an attenuation of the barrel vibration achieved by the vibration absorber. The gun barrel vibration absorber aims to reduce the flexural vibrations of gun barrels for increasing accuracy. Other enhancements include reduced interaction load between the barrel and projectile bore-rider during launch that favorably affects muzzle-end wear, and reduces exit yaw rate; a contributor to penetrator failure caused by incident yaw. The flexural dynamics of gun barrels during the launch of a round include the effects of the moving mass of the projectile that is constrained to follow the centerline of the cannon. Since the centerline can not be exactly straight, and since it may undergo dynamic flexure, interaction loads will develop as the round is forced to follow any curves of the centerline profile. These loads include centrifugal and Coriolis loads, which, in turn, cause additional flexure of the gun as the projectile proceeds down the barrel. In dynamics, this kind of system is termed non-self-adjoint and is neither linear nor stationary. It can be shown through detailed analysis that the interaction loads will generally increase as the centerline of the cannon deviates further from being perfectly straight. Thus, reducing the flexure of the cannon at the commencement of the firing may reduce the progression of the projectile interaction loads with the barrel during launch. To clarify, if a cannon were perfectly straight, no centrifugal nor Coriolis loads would be applied to constrain the round to follow the straight cannon. If an otherwise perfectly straight cannon were vibrating due to other environmental causes, such as a tank traversing rough terrain, the curvature of the vibrating barrel would cause centrifugal and Coriolis loads that would cause more curvature, and thus increase the constraint loads in a domino effect until the round exits the barrel. These interaction loads can become significant and result in the premature wear of contact surfaces, and subsequent barrel wear. In addition, the dynamic flexure of the cannon during launch also results in deviations from the intended exit direction of the round and subsequent reduction in system accuracy.

BRIEF DESCRIPTION OF THE DRAWINGS

The above and other features of the present invention and the manner of attaining them, will become apparent, and the invention itself will be best understood, by reference to the following description and the accompanying drawings, wherein.

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figure 1:
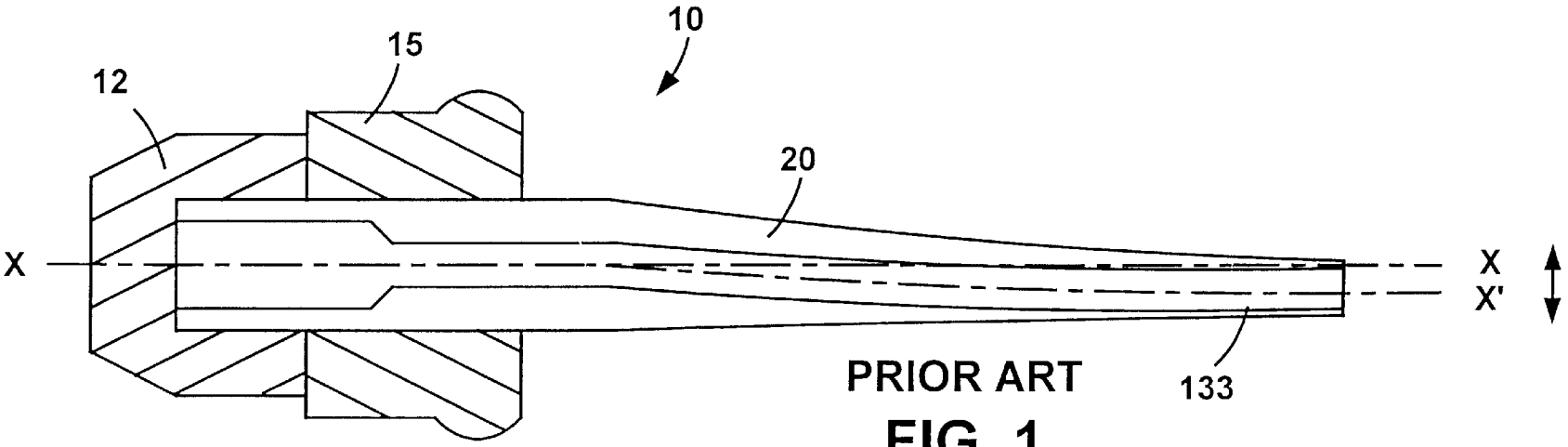
PRIOR ART FIG. 1
FIG. 1 is a schematic, cross-sectional, side elevational view of a prior art weapon system, illustrating a gun barrel in a vibratory position prior to firing.

FIG. 1 illustrates a conventional weapon system, such as a gun system 10 comprised of a breech 12, a mount fixture 15 and a gun barrel 20. The breech 12 enables a round of ammunition to be loaded in the gun system 10, and further enables the pressure within the gun barrel 20 to be contained during firing. The present invention can also be used with a special category of guns that do not fully contain the pressure. Rather, these guns allow the pressure to escape via a nozzle designed to permit the forward momentum of the projectile to be compensated by the rearward momentum of the combustion gases escaping through the nozzle. The guns in this special category are termed "recoiless guns."

The mount fixture 15 exemplifies a means by which the gun system 10 is coupled to a weapon platform, such as a helicopter, a tank, etc. The mount fixture 15 further enables the gun barrel 20 to recoil within it during firing, and repositions the gun barrel 20 after firing. The mount fixture 15 controls the cantelivered length of the gun system 10, and affects the fundamental resonance frequency of the gun barrel 20.

The gun barrel 20 contains propellant gas pressure, and further constrains the round of ammunition to follow a trajectory close to its center line X—X, while imparting kinetic energy to the round. When firing successive rounds, the gun barrel 20 vibrates, and its center line X—X deviation tends to follow the vibrations of the gun barrel 20. FIG. 1 illustrates one such vibratory state center line X–X' of the gun barrel 20. In general, the greater the deviation of the vibratory state center line X–X' from the resting state center line X—X, prior to firing the next round, the less the accuracy of the gun system 10 becomes. By reducing vibration, the trajectory of the round remains the closest to its static profile. It is conceivable to establish a desired vibratory stat of a cannon that would reliably increase the accuracy of cannons.

Figure 2:
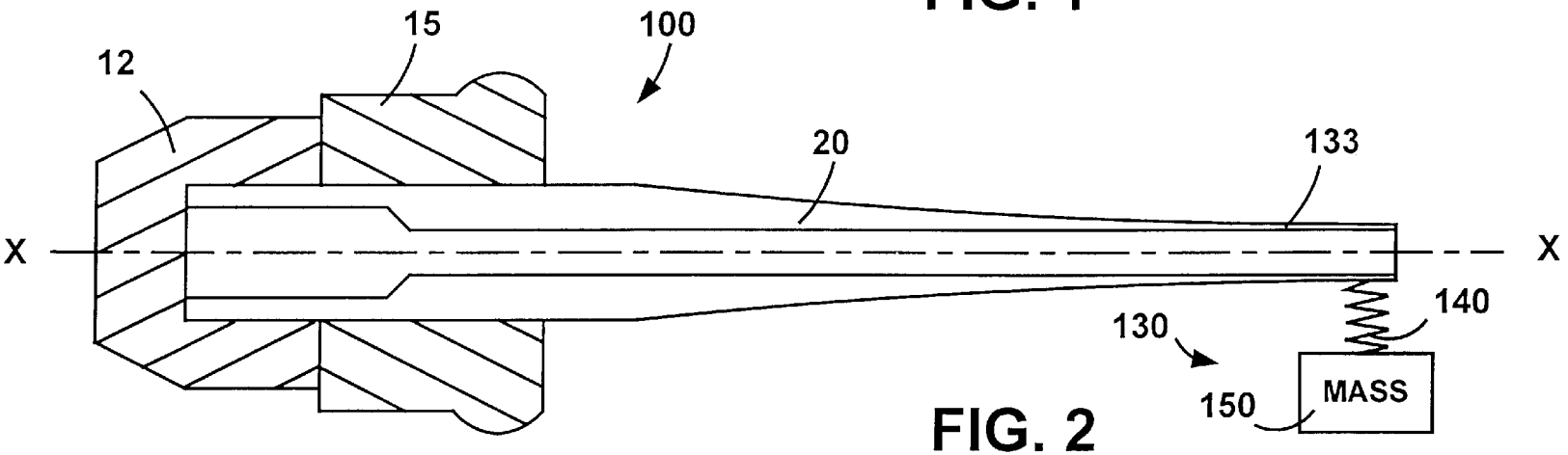
FIG. 2 is a schematic, cross-sectional, side elevational view of a weapon system embodying a vibration absorber according to the present invention, and illustrating the gun barrel in a substantial axial position prior to firing.

It is an important objective of the present invention to minimize the deviation between the two center lines X—X and X–X'. This objective is achieved by the gun system 100 illustrated in FIG. 2, which is generally similar to the gun system 10, and is fitted (or retrofitted) with a vibration absorber 130.

In one of its simplest embodiments, the vibration absorber 130 includes an energy storage device, for example, an elastic member, such as a spring 140 and a mass 150 secured to the spring 140. The spring 140 stores potential energy which is a function of the relative displacement between the gun barrel 20 and the displacement of the vibration absorber mass 150 from its datum position, while kinetic energy is stored in the inertia of the mass 150.

The potential energy stored in the spring 140 and the kinetic energy stored in the mass inertia are then dissipated in part as friction, and re-introduced in part to the gun barrel 20 such that the re-introduced energy is out of phase relative to the gun barrel motion. As a result, the function of the vibration absorber 130 is not to totally dissipate the stored energy, but rather to reshape the receptance of the gun system 100 so as to significantly reduce the vibration energy that migrates into the gun structure from known disturbances, thus improving the overall accuracy of the gun system 100. In addition, the vibration absorber 130 can reduce the load between the gun barrel 20 and the projectile during launch, thereby reducing the gun barrel muzzle wear and the exit yaw rate of the projectile.

Having provided an overview of the vibration absorber 130, attention presently turns to the details of the components constituting the vibration absorber 130. The vibration absorber 130 is preferably secured in proximity to the muzzle end 133 of the gun barrel 20. It should however be understood that the vibration absorber 130 can be coupled at any location along the gun barrel, provided that at the axial location chosen the amplitude of the vibratory mode shapes nearest the disturbance frequency are significant.

Several types of springs are available for implementing the vibration absorber 130. Springs store potential energy in their internal stress and strain during compression, and they introduce force between the muzzle end 133 and absorber mass. Thus, the spring 140 stores potential energy for reintroduction to the gun barrel 20 at different phases of vibration. This results in two new state variables for each degree of freedom (horizontal and vertical), to track this motion. Thus, a total of four new state variables have been introduced to track the kinetic and potential energies of each of the two new degrees of freedom. In addition, the spring 140 couples the kinetic energy stored in the mass (150) inertia to the motion of the muzzle end 133 of the gun barrel 20. The spring 140 can be an all compression spring constructed of flat wire with ground ends. The spring 140 can be for example, chrome-vanadium, ¾ inch hole size, ⅜ inch rod size, and it can have a length of 3, 3½, 4½, 5, or 6 inches with effective spring constants of 96, 80, 64, 56, or 40 lbf/in respectively. The spring 140 can be in a precompressed state when it is fitted to the gun barrel 20. The mass 150 is secured to the free end of the spring 140, and can vary for instance between 5 kilograms and 25 kilograms.

Figure 3:
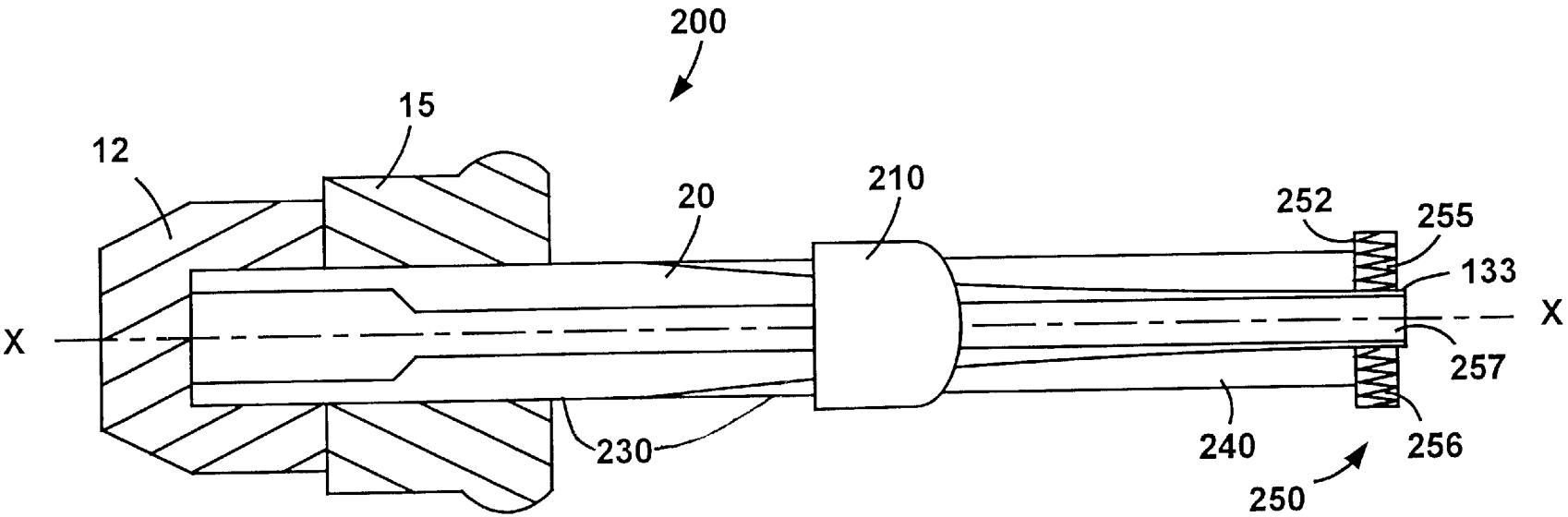
FIG. 3 is a schematic, cross-sectional, side elevational view of another weapon system according to a preferred embodiment of the present invention.

Turning now to FIG. 3, it illustrates another weapon system 200 according to a preferred embodiment of the present invention. The weapon system 200 is generally similar to the weapon system 100. The weapon system 200 further includes a bore evacuator 210, which is a light weight pressure vessel, that is mounted on the gun barrel 20, at a predetermined distance from the mount fixture 15 for example at about the middle of the gun barrel 20. The evacuator 210 functions by allowing a small portion of propelling gas to be vented into itself via small port holes drilled into the gun. After projectile discharge, the built up pressure is slowly released to sustain a down bore flow of the gas, and thus prevent combustion gases from billowing out of the breech when it is opened.

The weapon system 200 further includes a cylindrically shaped rear thermal shroud 230 and a cylindrically shaped forward shroud 240, that prevent uneven temperature distribution of the gun barrel 20. The thermal shrouds 230, 240 are secured on either side of the bore evacuator 210. The rear shroud 230 is secured at one end to the mount fixture 15 and at its other end to the bore evacuator 210. The primary purpose of the shrouds 230 and 240 until the advent of the present invention has been to reduce the deleterious affects of uneven thermal strain within gun barrels on dispersion.

The forward shroud 240 is secured between the bore evacuator 210 and constitutes the inertia element (in analogy with the mass 150 of FIG. 2) of the vibration absorber 250 referred to as the "dynamically tuned shroud", which is secured in proximity to the muzzle end 133. The primary purpose of the forward shroud 240 until the advent of the present invention has been to reduce the deleterious affects of uneven barrel heating on dispersion. The thermally induced bending of the gun barrel 20 produces large deviations in accuracy under uneven heating conditions such as direct sunlight. The current invention provides dual-use functionality. The role of the forward thermal shroud 240 in the current invention is to provide an inertia, whose forward coupling to the gun barrel 20, via springs 255 and 256, provides two new degrees of freedom to the gun system 200, while its aft end is free to pivot. These new degrees of freedom are tuned to reduce the structural vibrations of the gun system 200.

The total active inertia of the vibration absorber 250 includes a portion of the inertia of the forward shroud 240 (roughly half). The flexible constraint of the vibration absorber to the barrel 20 allows kinetic energy to be stored in the pivoting motion of the forward shroud 240 and reintroduced into the gun barrel 20 at different phases of vibration via springs 255, 256. This results in two new state variables for each degree of freedom (horizontal and vertical), to track the kinetic and potential energy.

The vibration absorber 250 includes a dynamically tunable spring collar 252 which is fixedly secured to one end of the forward shroud 240. The vibration absorber 250 also includes one or more springs that are housed within the spring collar 252. While only two springs 255, 256 are illustrated, it should be understood that a different number of springs can be used, as needed for the desired systems to which the present invention is applied. For example, the vibration absorber 250 can include eight radially extending, and generally evenly spaced springs 255, 256. Each spring, for example, spring 255, extends radially within the collar 252, and is precompressed between the muzzle end 133 of the gun barrel 20, and the collar 252. Springs 255, 256 are precompressed such that the datum position of the forward thermal shroud 240 is coincident with the centerline of the gun barrel 20, and maintain contact with both the barrel muzzle 133 and spring collar 252 during the relative motion of the vibration absorber 250.

The purpose of the dynamically tunable spring collar 252 is to enable relative motion between the muzzle end 257 of the pivoting forward thermal shroud 240 and the muzzle end 133 of the gun barrel 20. Further, the collar 252 provides a tunable constraint between the forward shroud assembly 240 and the gun barrel 20, via combinations of springs and/or dash-pots. For example, the collar 252 enables a combination of a plurality (for example eight) springs or spring packs 255, 257 and/or shock absorbers (not shown) to couple the gun barrel dynamically tuned shroud vibration absorber assembly 250 to the muzzle end 133 of the gun barrel 20. Each spring element, for example 255, 256, may be applied at collar 252 location referred to as spring stations. The spring stations can be evenly spaced within the collar 252, and are located as a clock face from 1:30, 3:00, 4:30, 6:00, 7:30, 9:00, and 10:30. The 12:00 station can be left open to provide an optical path for a continuous muzzle reference system (not shown).

The collar 252 can optionally include shock absorbers in combination with spring packs. It is important to note that even without the explicit incorporation of a dash-pot, friction is commonly introduced through relative motion between the absorber and the gun system 200, thus some damping is always present. An exemplary shock absorber is available from Taylor Devices Inc. Tonawanda, N.Y., model # UNI-SHOK 100, part number 67DP-12900-01.

A snubber liner (not shown) is fitted within the collar 252. A snubber is a component of most suspension systems that prevents metal to metal impact when the relative deflection between two components exceeds the available amplitude. The role of the snubber liner is to distribute the contact load over both a wider surface area, and an increased contact duration. The result is decrease peak load concentrations and reduced propensity for damage to the gun barrel 20. Snubber liners offer the added advantage of extracting a significant amount of vibrational energy via the highly inelastic momentum transfer between the two components. In the present example, the snubber liner can be a thin sheet (⅛ inch nominal) of Sorbothane brand energy absorbing rubber that has been applied to the inner diameter (about 7 inches) of the dynamically tunable spring collar 252. The snubber liner sheet is 1½ inches wide, with eight (8) 1 inch diameter holes punched in, to allow the precompressed springs 255, 256 to directly couple the forward shroud 240 to the gun barrel 20. Further information on the properties of the snubber liner material are available from: Sorbothane Inc., Kent, Ohio.

In this example, the inner diameter of the collar 252, can be selected such that after the application of the snubber liner deflections on the order of ⅛ an inch between the forward shroud 240 and the gun barrel 20 from a centered position are enabled. This gap can be referred to as the amplitude envelope, as it is the limit on the relative deflection between the dynamically tuned shroud assembly 250 and the muzzle end 133 of the gun barrel 20 during vibration.

Spring pack caps (not shown) may be used to preload the springs 255, 256 that couple the forward shroud 240 to the gun barrel 20. The caps may screw into receivers in the collar 252, such that turning the caps down may control the pre strain of the springs 255, 256.

The springs 255, 256 are all preloaded to maintain contact with the gun barrel 20, and to lift the static gravity load of the forward shroud 240 off of the muzzle end 133 of the gun barrel 20. The springs 255, 256 store potential energy in their internal stress and strain during compression, and they introduce force between the muzzle end 133 of the gun barrel 20 and the spring collar 252. The springs 252, 256 couple the motion of the dynamically tuned shroud assembly 250 to the motion of the muzzle end 133 of the gun barrel 20.

To facilitate convenient and optimal tuning of the present invention, the springs 255, 256 have a modular design to enable the use of different springs and spacers, so as to permit the implementation of a wide range of effective spring rates, and preloading of the forward shroud 240 to gun barrel 20 coupling for static centering. Additional details about the springs 255, 256 is available from McMaster Carr, New Brunswick, N.J. The part numbers of several springs 255, 256 used during testing are 9297K36, 9297K37, 9297K39, 9297K41, and 9297K42.

Push pins can be employed to transmit the load from the compression of the springs 255, 256 through the collar 252 to the muzzle end 133 of the gun barrel 20 and this prevents spring buckling. The push pin rides guide holes through the cap, and through the receivers incorporated in to the collar 252. The pins always remain in contact with the gun barrel 20 due to the compressive preload applied by the springs 255, 256 between the cap and the flange of the pins. Lubricant is applied along the guide surfaces to reduce friction and binding.

The coupling of the aft (or rear) end of the forward shroud 240 is achieved by a spherical slip coupling (not shown). This enables the forward shroud 240 to pivot up, down, and left, right relative to the barrel. The spherical slip coupling can be incorporated as part of the shroud (240) design, to prevent bucking failure of the thin aluminum forward shroud 240 during the large gun barrel flexures that accompany the launch dynamics. The role of the spherical slip coupling in the gun barrel dynamically tuned shroud assembly 250 is to allow free rotation of the forward shroud 240 at its aft end.

The spring collar 252 allows lateral translation of the muzzle end 257 of the forward shroud 240, thus enabling the entire shroud assembly 250 to pivot about the aft spherical joint. These new degrees of freedom in the dynamic system will effect a vibration absorber.

An extra mass coupler (not shown) enables split-rings (not shown) with a nominal weight of approximately 20 pounds (for example) to be clamped to the gun barrel dynamically tuned shroud assembly 250 in proximity to the spring collar 252, to provide an additional design parameter for optimized performance.

Conventional gun systems fitted with a shroud contain no provision for an engineered elastic coupling between the muzzle end of the shroud and the muzzle end of the gun barrel 20. In these conventional gun systems, a solid ring of steel is coupled to the aluminum shroud via screws reinforced by adhesive. Between the collar and the gun barrel 20, an O-ring is employed to allow the shroud to float on the end of the gun barrel 20, while preventing foreign material from entering the annular space between the shroud and the gun barrel 20. Although this O-ring can provide some compliance between the shroud and gun barrel 20, it is very stiff, and not designed to effect a vibration absorber. The purpose for allowing the muzzle end of the forward thermal shroud to "float" is to enable thermal expansion of the forward thermal shroud to reduce tolerance requirements upon interchangeable parts and to prevent compressive loads during recoil.

Prior to the advent of the present invention, the design of the forward thermal shroud provided all axial coupling through the spherical slip joint coupling. Thus, the entire span of the forward shroud was in tension throughout recoil, and, even though exceedingly little axial slip of the muzzle end of the shroud relative to the barrel muzzle is expected, allowing it to float ensures that the shroud is not loaded in compression during recoil.

Since the affect of the vibration absorber 250 on the overall gun system 200 design is relatively minimal, it may readily be retrofitted to any gun system that employs thermal shrouds with an integral spherical slip joint. It may also be retrofitted to other gun systems as well, with some additional redesign which should be clear to a person of ordinary skill in the field after reviewing the present description.

In other embodiments, any totally passive means of engineering the coupling constraint effected by the dynamically tunable spring collar 252 to move energy between the gun barrel 10, stored energy of the springs 255, 256, and kinetic energy of the forward shroud 240 could be employed to implement the present invent. Any variation that stores deflection energy between the relative motion of the forward shroud 240 and muzzle end 133 of the gun barrel 20 could alternatively be used in the implementation of the present invention. Such mechanisms include pneumatics, rubber springs, electro-magnetic devices, and various integral collar configurations, can substitute the modular spring pack approach described above.

It would also be possible to utilize the bending stiffness of the forward shroud assembly 240 itself to effect the spring coupling achieved by the springs 255, 256. This could be used if the spherical slip-joint were made rigid so that the forward shroud 240 cantilevers over the gun barrel 20. Thus, the first bending mode of the cantilevered forward shroud 240 would be used in lieu of the rigid body mode. A related variation would be the use of the higher bending modes of the forward shroud 240 to effect a vibration absorber.

The use of the rear shroud 230 as a vibration absorber can also be achieved provided the amplitude of the gun barrel 20 bending mode nearest the frequency of the troublesome vibration was significant.

For simplicity, the following presentation limits motion to the plane that contains the undeformed center line X—X of the gun barrel 20, and the vertical unit vector. Further, typical Euler beam assumption are used, such that axial motion is assumed to play no role. Vibration in the horizontal plane follows in complete analogy. For simplicity it is assumed that all deflections measure zero when no vibrations are present, although it is understood that static deflections such as gravity droop and manufacturing tolerance exist.

Deflection of the gun barrel 20 applies sufficient load to the rear coupling of the rear shroud 230 to keep the spherical slip joint constraint true. Thus, the acceleration at the rear of the rear shroud 230 is identical to the gun barrel 20 to which it is coupled (neglecting the slight off set of the center of the joint behind the rear end of the shroud). No torque is applied, the spherical joint is assumed frictionless. As this is a rigid lateral constraint, only the one deflection is required to describe the position of both components. This generalize coordinate will be named $y_{SC}$. It represents the lateral deflection of both the gun barrel 20 and the rear shroud 230 at the axial position of the spherical coupling.

Deflection of the gun barrel 20 at the collar 252 is directly translated to the deflection of the springs 255, 256. Thus, a load equal to the deflection multiplied by the effective spring constant is applied between the gun barrel 20 and the muzzle end 133 with equal magnitude and opposite direction. This load is treated separately in this sequence of operation. The principle of superposition allows the independent consideration of barrel deflection and shroud deflection. The shroud collar 252 is assumed to support no moment, thus no torque is applied between the gun barrel 20 and the forward shroud 240. The generalized coordinate that represents the deflection of the gun barrel 20 at the axial location of the dynamically tunable spring collar coupling will be named $y_{BM}$. The effective stiffness of the springs 255, 256 in the vertical plan will be named $K_V$, in units of force over displacement.

Deflection of the forward shroud 240 at the collar 252 is also analogous to the deflection of the gun barrel 20 at the collar 252, as described above. The generalized coordinate that represents this deflection will be named $y_{SM}$.

The relative velocity of the spring collar 252 to the muzzle 133 of the gun barrel 20 ($d(y_{SM}-y_{BM})/dt$) effects a load due to the friction and dissipation effected by the mechanism. Using the typical viscous approximation, this load is equal to the velocity of the relative motion multiplied by the effective damping term. The effective damping of the assembly including both friction and shock absorbers will be named $B_V$. The linear damping approximation is not required for most dynamically tuned shroud designs. However, it provides a simplified mathematical basis for illustration.

The energy is shifted to the gun barrel vibration absorber 250 in three ways; two of which reintroduce it back to the gun system 200 in different phase. First, potential energy (PE) is stored in the springs as described by the following equation:

$$PE = \frac{Kv}{2}(y_{BM} - y_{SM})^2$$

Second, vibrational power (DP) is released by the dissipation, as illustrated by the following equation:

$$DP = BV(\dot{y}BM - \dot{y}SM)^2$$

Third, Kinetic energy (KE) is stored in the shroud inertia as illustrated by the following equation:

$$KE = \frac{1}{2}\cdot[\dot{y}_{SC} - \dot{y}_{SM}]\cdot\begin{bmatrix} m11 & m12 \\ m21 & m22 \end{bmatrix}\cdot\begin{bmatrix} \dot{y}_{SC} \\ \dot{y}_{SM} \end{bmatrix}$$

where m represents the off axis mass term.

Under these conditions, the inertia of the forward shroud 240 has three terms, the lateral inertia at either end, and an effective rotational inertia of the forward shroud 240. The rotational inertia term is repeated in both off axis mass terms, $m_{12}$ and $m_{21}$. The absence of the rotational degrees of freedom is due to the rigid body assumption, under which the angle of the forward shroud 240 is completely defined by $y_{SC}$ and $y_{SM}$, and thus the traditional four by four inertia matrix of a single finite element may be collapsed into a two by two matrix representation shown above.

The forces transmitted between the gun barrel 20 and the rear shroud 230 and the forward shroud 240 are represented by the following two equations:

The force applied to the gun barrel 20 by the rear shroud 230 at the rear coupling:

$$F_{BR} = -[m11 \quad m12]\cdot\begin{bmatrix} \ddot{y}_{SC} \\ -\ddot{y}_{SM} \end{bmatrix}$$

The force applied to the gun barrel 20 by the forward shroud 240 is illustrated by the following equation:

$$FSM = -KV.(yBM - ySM) - BV.(\dot{y}BM - \dot{y}SM)$$

It can be seen that if the forward shroud 240 were pinned to the gun barrel 20 at the trunnion constraints, the equations of motion collapse to one degree of freedom. The trunnions effect a rigid lateral constraint. Using simple engineering arguments about the behavior of tapered beams (gun barrels) it can be seen that vibrational activity at the location of the bore evacuator is small, relative to the muzzle, due to its proximity to the trunnions.

Testing of a dynamically tuned shroud was conducted on a 120 mm cannon mounted to a tank that was driven over a bump course. See Kathe, "Performance Assessment of a Synergistical Gun Barrel Vibration Absorber During Bump Course Testing," ARDEC Technical Report ARCCB-TR-97022, September 97.

Figure 4:
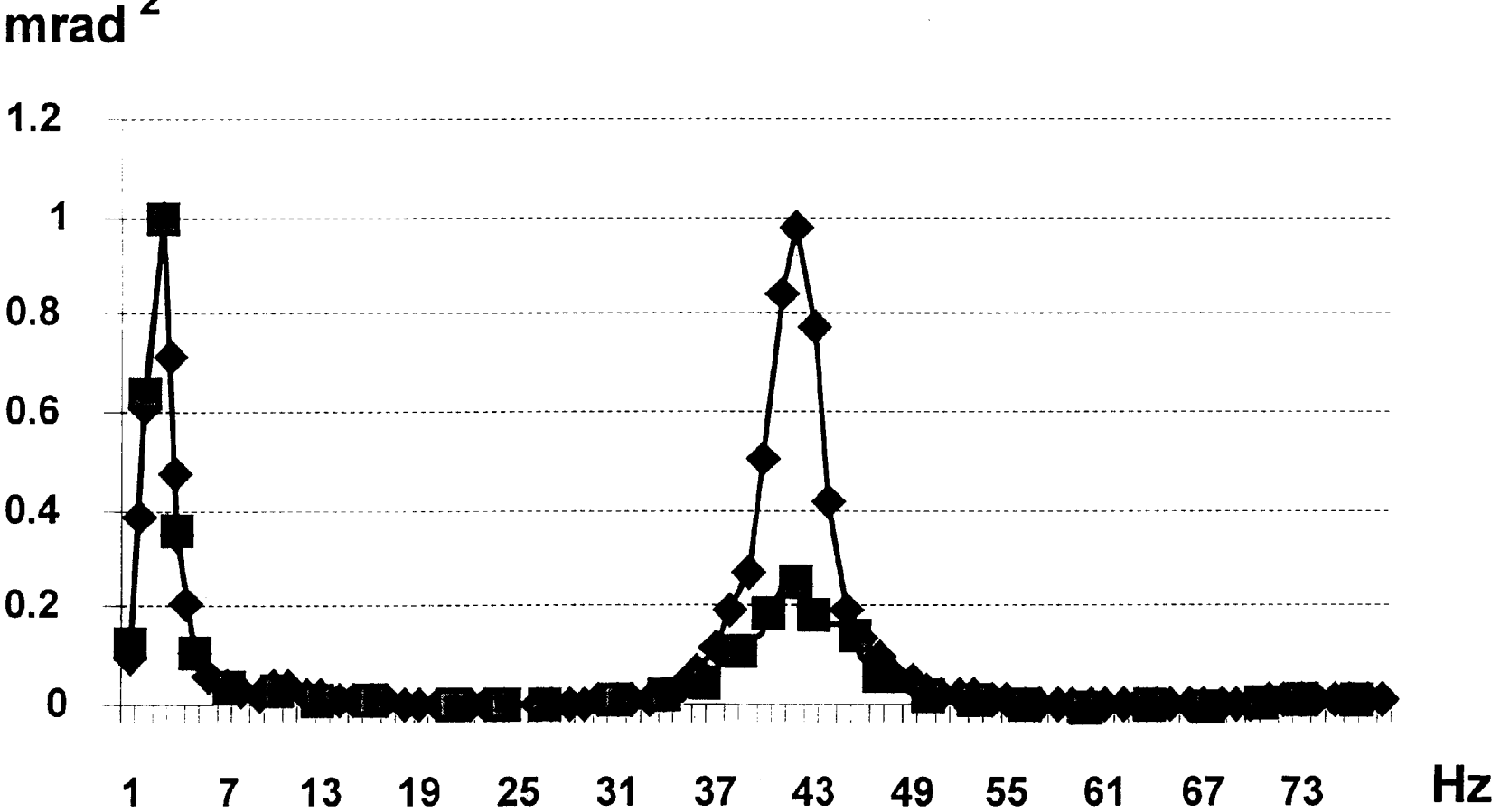
FIG. 4 is a graph plotting the power spectrum, which is indicative of the frequency distribution of vibration energy.

With reference to FIG. 4, the power spectra for the base-line and vibration absorber test results were computed using a 1024 element Hanning window (2.2 seconds at the data sampling frequency of 463 Hz). An overlap of half the window size was used to reduce leakage effects from the non-stationary behavior of the bump-course. The power spectra for each of the runs were subsequently averaged to reduced sensitivity to variation in traversing the bump course.

It should be apparent that many modifications may be made to the invention without departing from the spirit and scope of the invention. Therefore, the drawings, and description relating to the use of the invention are presented only for the purposes of illustration and direction.

What is claimed is:

1. A weapon system comprising:

a gun barrel;

a breech;

a mount fixture;

a vibration absorber fitted onto a free end of said gun barrel, said vibration absorber including an energy storage device and a mass secured to said energy storage device;

a bore evacuator mounted on said gun barrel, at a predetermined distance from said mount fixture; and wherein when said gun barrel is in motion, said energy storage device stores potential energy which is a function of a relative displacement between said gun barrel and a displacement of said vibration absorber from its datum position, while kinetic energy is stored in the inertia of said mass; and wherein said stored potential energy and kinetic energy are re-introduced at least in part to said gun barrel in an out of phase relation relative to the gun barrel motion, for reshaping a receptance of the weapon system, so as to reduce vibration energy; and wherein said breech enables a round of ammunition to be loaded into the gun barrel, and further enables pressure within said gun barrel to be contained during firing; and said mass includes a forward thermal shroud secured on one side of said bore evacuator, said forward thermal shroud being secured between said bore evacuator and said vibration absorber, and wherein said energy storage device includes a dynamically tunable spring collar which is fixedly secured to one end of said forward thermal shroud, and wherein said vibration absorber includes at least one spring housed within said spring collar; and a rear thermal shroud secured on an opposite side of said bore evacuator from said forward thermal shroud.

2. A weapon system according to claim 1, wherein said spring collar includes at least eight radially extending and generally evenly spaced springs.

3. A weapon system according to claim 1, wherein said spring collar includes at least two radially extending and spaced apart springs.

4. A weapon system according to claim 3, wherein each of said springs extends radially within said collar, and is secured at one of its ends to a muzzle end of said forward thermal shroud, and is also secured at its other end to said collar.

* * * * *